US009505121B2

(12) United States Patent
Pearson

(10) Patent No.: US 9,505,121 B2
(45) Date of Patent: Nov. 29, 2016

(54) SAWHORSE

(71) Applicant: Darren Jon Pearson, Leek (GB)

(72) Inventor: Darren Jon Pearson, Leek (GB)

(73) Assignee: Darren Jon Pearson, Leek, Staffordshire (GB)

( * ) Notice: Subject to any disclaimer, the term of this patent is extended or adjusted under 35 U.S.C. 154(b) by 119 days.

(21) Appl. No.: 14/389,977

(22) PCT Filed: Mar. 28, 2013

(86) PCT No.: PCT/GB2013/050825

§ 371 (c)(1),
(2) Date: Oct. 1, 2014

(87) PCT Pub. No.: WO2013/150278

PCT Pub. Date: Oct. 10, 2013

(65) Prior Publication Data

US 2015/0047926 A1 Feb. 19, 2015

(30) Foreign Application Priority Data

Apr. 2, 2012 (GB) ..... 1205866.5

(51) Int. Cl.
*B25H 1/06* (2006.01)
*B25H 1/14* (2006.01)
*B27B 21/00* (2006.01)

(52) U.S. Cl.
CPC *B25H 1/06* (2013.01); *B25H 1/14* (2013.01); *B27B 21/00* (2013.01)

(58) Field of Classification Search
CPC ..... B23Q 1/262; B25H 1/0035; B25H 1/06; B25H 1/04; B25H 1/14; B27B 21/00
USPC ..... 182/153–155, 225
See application file for complete search history.

(56) References Cited

U.S. PATENT DOCUMENTS

| | | | | |
|---|---|---|---|---|
| 25,039 | A * | 8/1859 | Parkhurst | 211/198 |
| 314,986 | A * | 4/1885 | Aenis | 451/360 |
| 1,672,502 | A * | 6/1928 | Roth | 182/183.1 |
| 2,410,330 | A | 10/1946 | Ashenfelter | |
| 2,825,606 | A * | 3/1958 | Rebensdorf | 182/153 |
| 3,045,777 | A * | 7/1962 | Dintelmann | 182/153 |
| 3,086,740 | A * | 4/1963 | Hatton | 248/166 |
| 4,148,504 | A * | 4/1979 | Rushing | 280/756 |
| 4,804,064 | A * | 2/1989 | Coultrup et al. | 182/155 |
| 5,064,156 | A | 11/1991 | Handler et al. | |
| 5,297,655 | A * | 3/1994 | Wolfe | 182/153 |
| 5,484,037 | A | 1/1996 | Neumarkel | |
| 5,560,449 | A | 10/1996 | Smith | |
| 5,709,373 | A | 1/1998 | Wasylynko | |

(Continued)

FOREIGN PATENT DOCUMENTS

| | | |
|---|---|---|
| FR | 2830730 | 4/2003 |
| NL | 1023576 | 12/2004 |

*Primary Examiner* — Katherine Mitchell
*Assistant Examiner* — Shiref Mekhaeil
(74) *Attorney, Agent, or Firm* — Hamre, Schumann, Mueller & Larson, P.C.

(57) ABSTRACT

A sawhorse trestle has a discontinuous work-surface which is adjustable so as to provide a variable aperture between respective parts (2, 12) of the work-surface. Thus, the trestle may include two half-trestles (10, 20), each including two hinged frames (1, 11) topped by a horizontal support member (2, 12) providing part of the work-surface, those half trestles (10, 20) being connected by an adjustable, such as slideable, connector (3).

4 Claims, 2 Drawing Sheets

(56) References Cited

U.S. PATENT DOCUMENTS

| | | | | |
|---|---|---|---|---|
| 5,762,444 | A | 6/1998 | Giannelli | |
| 6,123,173 | A * | 9/2000 | Patros | 182/181.1 |
| 8,360,374 | B2 * | 1/2013 | Truitt | 248/171 |
| 8,602,229 | B2 * | 12/2013 | Raghunathan et al. | 211/119.01 |
| 2004/0262466 | A1 * | 12/2004 | Blattner | 248/166 |
| 2008/0302604 | A1 | 12/2008 | Kramer | |
| 2010/0084221 | A1 | 4/2010 | Cuccio | |

* cited by examiner

SAWHORSE

BACKGROUND

The present invention relates to a sawhorse or trestle for use in carpentry, building and similar, particularly for the sawing of sheets and boards of wood or other material.

A sawhorse is a well-known device used for supporting wood, plaster board and other building material, especially for marking up and cutting to size. It consists of one or, more commonly, a pair of trestles, which are arranged so as to support the material being worked on at a convenient height and position. Various adjustable saw-horses have been described allowing adjustment of the height (such as U.S. Pat. No. 5,064,156) or the angle (such as U.S. Pat. No. 5,560,449) of the support.

However, in supporting a board or broad sheet of material for accurate cutting, it is frequently necessary to reposition the sheet during sawing to avoid cutting the saw-horse supporting surface itself. This is inconvenient and leads to inaccuracy, especially where longitudinal cutting of large pieces is involved. There is also a need for a convenient means of supporting large boards or sheets securely in such a way that long cuts may be made continuously without needing to adjust their position and so as to prevent tearing of the material as the cut nears completion.

Sawhorses having discontinuous support surfaces, that is to say support surfaces provided with one or more recesses are disclosed in US 2008/0302604 and US 2010/0084221.

SUMMARY OF THE INVENTION

The present invention provides a sawhorse trestle with a discontinuous supporting work-surface, for supporting a work-piece, which is adjustable so as to provide a variable aperture between respective parts of the work-surface. This aperture allows the passage of a saw blade or similar tool while the remaining surface still supports the material being sawn. In its simplest form this may be a rigid A-frame trestle wherein the connecting function of the apical horizontal supporting member is replaced by additional cross members lower in the frame and the supporting member includes a removable section, or a hinged or folding section of an otherwise continuous supporting member.

However, preferably, the improved saw-horse trestle is adjustable with a split or discontinuous supporting member and a means by which the portions of the discontinuous supporting member or, preferably, halves of the trestle, may be progressively parted and optionally locked in any position, both so as to allow the blade of a saw to pass and also to adjust the effective width of the saw horse according to the size of board or other work-piece. Such an arrangement also aids in supporting both pieces of a work-piece during cutting and following completion of the cut, reducing the need for a second operator to hold one or both pieces.

In one preferred embodiment the sawhorse trestle comprises two half-trestles connectable by adjustable connecting means. It is further preferred that the adjustable connecting means comprises a slideable mechanism allowing variable spacing between the half-trestles. Most preferably this adjustable connecting means may be locked to hold the mechanism stably in any desired position.

The sawhorse trestle may further comprise securing means to firmly attach the work-piece to the work-surface. Such means may include clamps or straps. The sawhorse trestle may also include auxiliary supporting means such as rods or bars extending from the frame or supporting member so as to support, for example, flexible or fragile boards. Such supporting means may be removable and/or extensible.

The adjustable sawhorse trestle of the invention may be constructed of any suitable materials, for example wood or metal (such as aluminium or steel) or plastics material. In particular, polymeric plastic materials may be used by any of a wide variety of moulding processes. For example injection moulding (using such materials as Acrylonitrile-Butadiene-Styrene (ABS), Nylon (PA), Polycarbonate (PC), Polypropylene (PP) and Polystyrene (GPPS)); extrusion blow moulding (using such materials as Polypropylene (PP), Polyethylene (PE), Polyethylene-Terephthalate (PET) and Polyvinyl chloride (PVC)); and extrusion profile moulding (using materials like high-density polyethylene (HDPE), polyvinyl chloride (PVC) and polytetrafluoroethylene (PTFE)-filled PVC). Glass-reinforced plastics made by, for example, resin transfer moulding may also be used with any of a wide range of resin systems including polyester, vinylester, epoxy, phenolic and methyl methacylates.

DRAWINGS

The invention will be described further, by way of example, by reference to the accompanying drawings in which.

DETAILED DESCRIPTION

Figure 1:
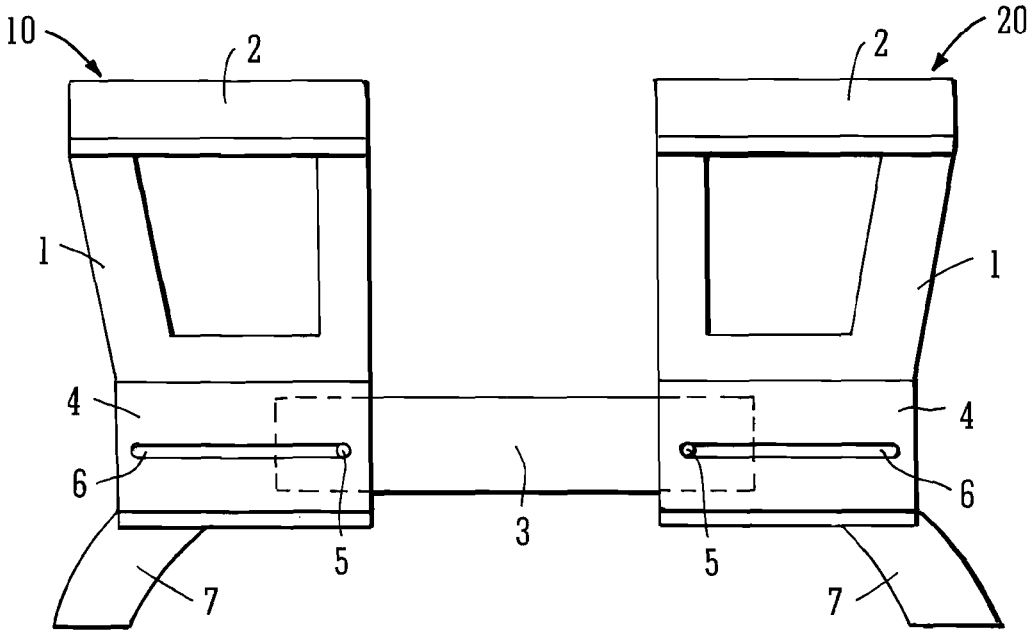
FIG. 1 is a side view of an embodiment of an adjustable saw horse trestle in accordance with the invention in an extended position.
Figure 2:
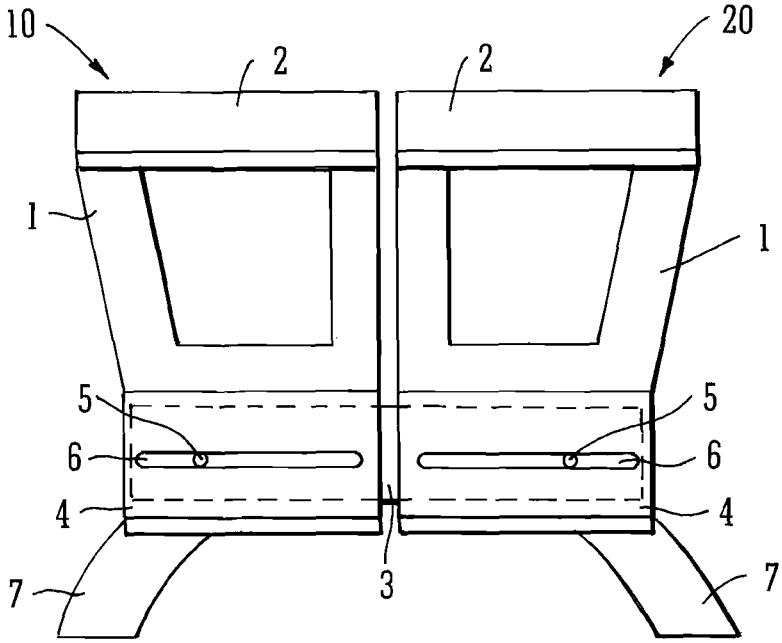
FIG. 2 shows the same device in a closed position with the slide mechanism retracted.

One embodiment of the adjustable sawhorse of the invention is shown in the Figures. Each sawhorse trestle comprises two half-trestles 10, 20 each of which, in turn, comprises two frames 1, 11 (see FIGS. 3 and 4). Each frame 1, 11 is topped by an essentially horizontal support member 2, 12, on which the work-piece (not shown) is placed. In general, the trestles are used in pairs to support the work-piece horizontally, although more may be used to support large and/or flexible items. Each frame 1, 11 may be supported by a respective leg 7, 17, which may optionally be adjustable to allow for levelling and improved stability on an uneven surface.

Figure 3:
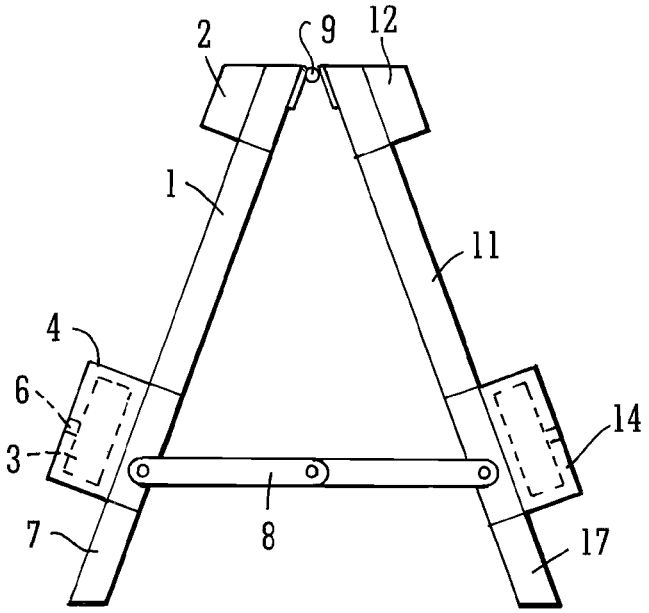
FIG. 3 is an end view of the trestle in its working position with the hinged portions opened.
Figure 4:
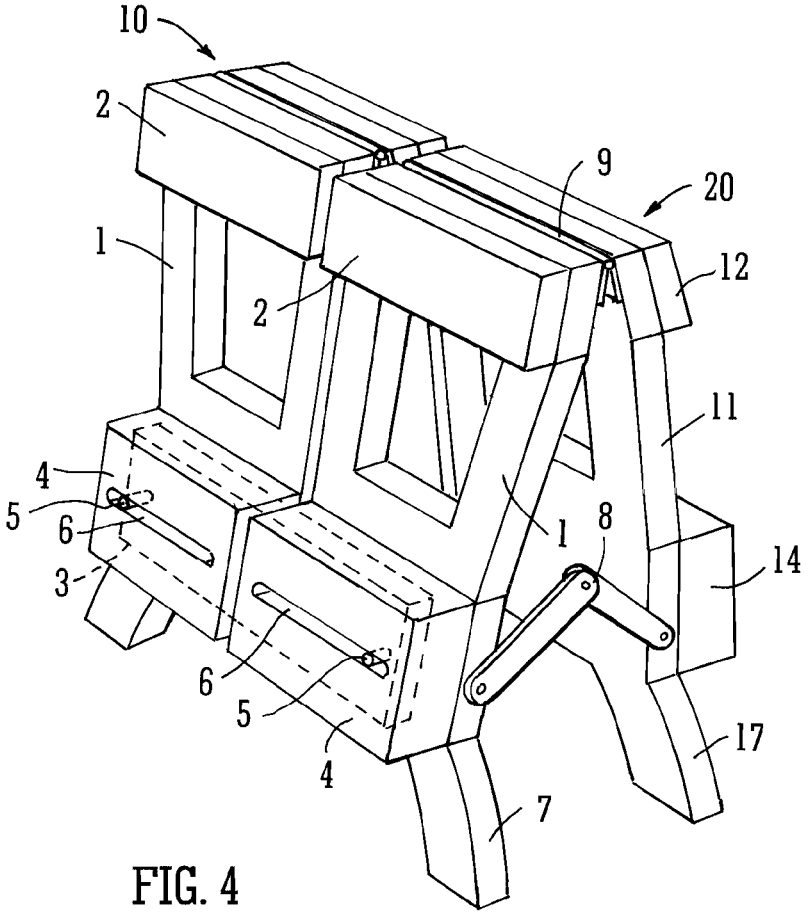
FIG. 4 is a perspective view of the same embodiment of sawhorse trestle as in the preceding figures.

The frames 1, 11 are joined and connected by a hinge 9 along the support members 2, 12 providing a support surface in a simple folding A-frame arrangement (see FIG. 3). Any suitable mechanism may be used to hinge the frames, including continuous or discontinuous hinges, or flexible connecting materials. Where the frames 1, 11 are formed of moulded polymeric materials, for instance, the frame pairs may be formed from a single moulding with a flexible hinge region.

The two half-trestles 10, 20 are adjustably connected by a pair of connecting slides 3, which are each held and guided by a respective retaining slide box 4, 14. Each slide 3 may be further guided and aligned by means of a peg or bolt 5 running in a longitudinal slot 6 in the wall of the respective slide box 4, 14. The peg or bolt 5 may further allow locking of at least one of the slides 3 in any position at one or both ends by means of a suitable screw or clamp (not shown). It will be clear that alternative arrangements are possible and that any suitable adjustable connecting means, for example, telescopic or spring-actuated using rods, pins or similar to provide a slideable mechanism, or of lazy tong style using pivotable linkages, may be used, so long as reasonably holding the half-trestles 10, 20 in alignment with each other. The lockable slide arrangement (or other functionally equivalent connection) allows the half-trestles 10, 20 to provide a variable aperture between the respective pairs of support members 2, 12 during use, both to provide a space for a saw blade or similar tool to pass without the need to reposition the work-piece, and also to allow the width of the trestle to be adjusted to adequately support work-pieces of various sizes and flexibility.

When in its working position with the hinges 9 open, the half trestles 10, 20 may be locked by suitable struts 8, which may be folding and/or pivoted. Alternatively, any suitable means of limiting the extent of opening, such as telescopic struts, hinges with a limited range of opening, or simple cords or chains may be used.

The invention claimed is:

1. A sawhorse trestle, comprising:

two half-trestles connected by adjustable connecting elements so as to provide a discontinuous work-surface with a variable spacing between respective parts of the work-surface, wherein each half-trestle includes two frames hingedly connected to each other, each of the frames including an upper frame member and a leg at a lower end of the upper frame member, each of the frames being topped by a substantially horizontal elongate support member extending in a direction of a major longitudinal axis along a top of each upper frame member of each half-trestle providing a portion of the work-surface, the frames being joined and hinged along the support members, the lower end of the upper frame member of each frame being disposed at an opposite end from the support members, each of the frames including a slide box secured to the lower end of the upper frame member, and wherein the adjustable connecting elements each comprise an elongate beam, each of the elongate beams extending between the two-half trestles and each of the elongate beams having a first end portion slidingly retained in one of the slide boxes of each of the two frames of a first of the two-half trestles and a second end portion slidingly retained in a respective one of the slide boxes of each of the two frames of a second of the two half-trestles on a corresponding side of the second half-trestle, thereby allowing the variable spacing between the respective parts of the work-surface.

2. The sawhorse trestle according to claim 1, wherein the elongate beams are disposed on outer sides of each of the two frames.

3. The sawhorse trestle according to claim 1, wherein the variable spacing between the respective parts of the work-surface is based on a length of the elongate beams.

4. The sawhorse trestle according to claim 1, wherein the substantially horizontal support member of each trestle is configured to support a work-piece.

* * * * *